US007095383B2

(12) United States Patent
Zigler et al.

(10) Patent No.: US 7,095,383 B2
(45) Date of Patent: Aug. 22, 2006

(54) FIELD CONFIGURABLE RADIATION ANTENNA DEVICE

(75) Inventors: Robert Zigler, Marysville, WA (US); For Sander Lam, Bothell, WA (US)

(73) Assignee: Intermec IP Corp., Everett, WA (US)

( * ) Notice: Subject to any disclaimer, the term of this patent is extended or adjusted under 35 U.S.C. 154(b) by 13 days.

(21) Appl. No.: 10/924,368

(22) Filed: Aug. 23, 2004

(65) Prior Publication Data

US 2005/0052325 A1 Mar. 10, 2005

Related U.S. Application Data

(63) Continuation-in-part of application No. 10/429,105, filed on May 1, 2003, now Pat. No. 7,006,053.

(60) Provisional application No. 60/496,468, filed on Aug. 20, 2003.

(51) Int. Cl.
*H01Q 19/30* (2006.01)
*H01Q 9/16* (2006.01)

(52) U.S. Cl. ..... 343/819; 343/793

(58) Field of Classification Search ..... 343/818, 343/819, 898, 793

See application file for complete search history.

(56) References Cited

U.S. PATENT DOCUMENTS

| | | | | |
|---|---|---|---|---|
| 4,663,632 | A | 5/1987 | Budrow et al. | |
| 4,983,988 | A | 1/1991 | Franke | |
| 5,389,941 | A | 2/1995 | Yu | |
| 5,469,181 | A | 11/1995 | Yarsunas | |
| 5,532,707 | A | 7/1996 | Klinger et al. | |
| 5,867,130 | A | 2/1999 | Tay et al. | |
| 6,008,773 | A * | 12/1999 | Matsuoka et al. | 343/818 |
| 6,198,460 | B1 | 3/2001 | Brankovic | |
| 6,342,867 | B1 * | 1/2002 | Bell | 343/795 |
| 6,839,038 | B1 * | 1/2005 | Weinstein | 343/795 |

* cited by examiner

*Primary Examiner*—Shih-Chao Chen

(57) ABSTRACT

Field Configurable Radiation Antenna Device for fixed dipole antenna comprising of a hollow tube and at least one pair of directional vanes is described. The beam direction of the antenna can be changed by operationally connecting multiples pairs of directional vanes to the hollow tube and by rotating the directional vanes relatively outer peripheral surface of the hollow tube. Such adjustments allow the user to tune the antenna to meet new or unforeseen coverage issues.

7 Claims, 5 Drawing Sheets

FIELD CONFIGURABLE RADIATION ANTENNA DEVICE

CROSS REFERENCE TO RELATED APPLICATIONS

This application is a continuation in part application of, and claims priority from, U.S. patent application Ser. No. 10/429,105 filed May 1, 2003 now U.S. Pat. No. 7,006,053. This application also claims priority from U.S. provisional application Ser. No. 60/496,468 filed Aug. 20, 2003.

BACKGROUND OF THE INVENTION

1. Field of the Invention

The present invention generally relates to a directional radio antenna, and more particularly, to a directional dipole antenna with adjustable reflector(s).

2. Description of Related Art

An antenna is a resonant device that transmits and/or receives electromagnetic waves. Electromagnetic waves are often referred to as radio waves. An antenna must be tuned to the same frequency band that the radio system to which it is connected; otherwise, reception and/or transmission will be impaired. The antenna size regularly refers as relative to wavelength. For example: a half-wave dipole, which is approximately a half-wavelength long. Wavelength is the distance a radio wave will travel during one cycle.

Gain and directivity are intimately related in antennas. The directivity of an antenna is defining a radiation of the RF energy directionally. It is quite intuitive that if the amount of radiating RF energy remains the same, but is distributed over less area, the apparent signal strength is higher in some particular direction. In another words, the directivity is the ability of an antenna to focus energy in a particular direction when transmitting or receiving energy. The attained increase in signal strength is the antenna gain. The gain is measured in decibels over either a dipole or a theoretical construct called an isotropic radiator. The qualitative relation between gain and directionality can be defined as gain=efficiency/directivity, where the antenna efficiency takes into account losses associated with the antenna structure and input terminals.

Another important characteristic of the antenna is a beamwidth, which characterizes the directivity of the antenna. The beamwidth is typically measured between the −3 dB points, i.e. the points on the main lobe where the signal strength drops off −3 dB (one-half) from the maximum signal point. The gain of the antenna is inversely proportional to the beam width: the narrower the beamwidth the higher the gain.

The antennas usually classified by the radiation characteristics on omnidirectional and directional antennas. Radio antennas produce a three-dimensional radiation pattern; however, for the description of the present invention it will be enough to analyze two-dimensional patterns from top or side projections The omnidirectional antenna radiates or receives electromagnetic waves equally well in all directions and does not favor any particular direction. One way to view the omnidirectional pattern is that it is a slice taken horizontally through the three dimensional sphere.

Directional antennas focus energy in a particular direction. Directional antennas are primary used in applications where the coverage is preferable over some particular sector, and when one site needs to connect to only one other site or to multiple sites in same directional line, and omnidirectional coverage is not required. For example, point-to-point links are benefit from using directional antennas because it will minimize interference and maximize communications distance between these two sites. FIG. 2 shows the beam pattern 201 for a dipole antenna 202 without a reflector, and FIG. 3 shows the beam pattern 302 for a dipole antenna 303 with a flat reflector 301.

Directional or reflector antenna, in one form or another, have been used since the discovery of electromagnetic wave propagation in 1888 by Hertz. Although directional antennas may take many geometrical configurations, in practical applications the most widely used shapes are the plane, corner, and curved reflectors, and the paraboloid. Azimuth radiation patterns of direct, reflected, and diffracted rays of the vertical omni dipole antenna may be calculated analytically using the corresponding formulas that may be found in Balanis, Constantine, *Antenna Theory: Analysis and Design*, John Wiley & Sons, Inc. (1997).

To improve the collimation of the radiation pattern in the forward direction, the geometrical shape of the flat reflector must be changed in the way to prohibit radiation in the back and side directions. One configuration, which achieving this goal is a combination of two flat reflectors joined so as to form a corner. Because of the simplicity of such construction, the corner reflector found many applications.

FIG. 4 shows top views of a radiation pattern for two corner reflectors 402 and 404 (406 and 408) placed at quarter wavelength behind the dipole antenna 401 (409). The azimuth radiation pattern of directed rays for the vertical omni dipole antenna 401 (409) with two corner reflectors composes the shape 403, 405 (407, 410) and depends on such parameters as the spacing distance between the vertex of the reflector and the dipole antenna, circular angle between vertexes of reflectors, the aperture of the corner reflector, etc.

FIG. 5 shows top views of a radiation pattern for three corner reflectors 502, 506, and 507 placed at quarter wavelength behind the dipole antenna 503. The azimuth radiation pattern of directed rays for the vertical omni dipole antenna 503 with these three corner reflectors composes the shape 501, 504, and 505.

FIG. 6 shows top views of a radiation pattern for four corner reflectors 509, 511, 514 and 515 placed at quarter wavelength behind the dipole antenna 516. The azimuth radiation pattern of directed rays for the vertical omni dipole antenna 516 with these four corner reflectors composes the shape 508, 510, 512 and 513.

A general concept of antenna reflectors and many particular applications have been discussed in a number of U.S. patents and publications.

The U.S. Pat. No. 4,663,632 "Extendable directional dipole antenna" discloses an extendable directionally adjusted dipole antenna suitable for use with motor vehicles. The antenna includes a vertical column having an extendable dipole arrangement at its upper end utilizing flexible actuators associated with a pair of reels where the actuators and associated telescoping antenna assemblies are simultaneously extended and retracted. An operating shaft for rotating the reels extends through the column and either manual or electric means rotate the shaft. The column is rotatable for directional adjustment, and under manual control the shaft extends through the vehicle roof permitting interior adjustments.

The U.S. Pat. No. 4,983,988 "Antenna with enhanced gain" discloses a combination of the plurality of vertically-polarized, omni-directional antennae having a reflector added to each one to limit the horizontal beamwidth to 90 degree and increase the gain to 16 dB. By utilizing four antennae and utilizing power combining hybrids to connect each of the two opposed antennae together, excess gain over a 10 dB omni-directional system will be obtained. The vertical beam width and physical height of the antenna are preserved with the increase in gain at the cost of an additional antenna complexity.

The U.S. Pat. No. 5,389,941 "Data link antenna system" discloses an antenna that employing the back radiation of a crossed-dipole to illuminate a parabolic cylindrical reflector. The crossed dipole is supported by a feed network mast, which simplifies the feed network and eliminates the need for other supporting structure and its electrical blockage. To provide an omni-directional radiation coverage, four of these antennas are located at the four quadrants, each covering one quadrant in the azimuth direction. The RF signal is fed through a single switch to the selected antenna to be radiated to the desired direction.

The U.S. Pat. No. 5,469,181 "Variable horizontal beam width antenna having hingeable side reflectors" discloses a broadband directional antenna having a central reflector plate, a dipole and at least one side reflector panel. The dipole is arranged on the central reflector plate for radiating a radio frequency signal, including a binary feed network having a microstrip transmission line and a collinear array of radiating elements. The side reflector panel is hinged to the central reflector plate for adjusting the horizontal radiation beamwidth of the radio frequency signal.

The U.S. Pat. No. 5,532,707 "Directional antenna, in particular dipole antenna" discloses a directional dipole antenna that is designed comparatively simply, and has improved electrical properties. It is provided that the symmetrical part of the antenna is made from the material of the reflector cut from the remaining material of the reflector wall, except for a connecting segment, which is cut preferably in the region of the immediate connecting point with the remaining material of the reflector wall and bent out relative to the plane of the reflector wall.

The U.S. Pat. No. 5,867,130 "Directional center-fed wave dipole antenna" discloses a directional center-fed half wave dipole antenna is constructed from a multilayer substrate having dipole antenna elements disposed on opposite surfaces of the multilayer substrate. An energy reflector is disposed on at least one side of the substrate and positioned adjacent to the dipole antenna elements that are fed by a center feed member that has a tapered width so as to provide the necessary impedance matching. A ground plane is disposed within the multilayer substrate, the elements of which are positioned on both sides of the center feed element.

The U.S. Pat. No. 6,198,460 "Antenna support structure" discloses an antenna support structure for at least three directional antenna sub-systems that can be planar antenna arrays. The antenna support structure comprises at least four panels adapted to support respectively one of the antenna sub-systems. The first two panels include a main panel and at least three secondary panels respectively adjacent to the main panel. The secondary panels can be respectively attached by hinge means to the main panel. In additon, the secondary panels can be individually adjusted in a predetermined angle to the main panel. The antenna support structure according to the invention can be particularly used in combination with wide-band printed dipole antennas for microwave and millimeter-wave applications.

In practical applications, if an omni antenna is already in place, and the coverage pattern needs to be adjusted according to the user specifications, the user typically would change antenna. The present invention is directed to the preserve existing antenna and to change the radiation pattern of installed antenna by putting over the antenna a plastic tube with reflective directional vanes.

SUMMARY OF INVENTION

Briefly, and in general terms, the present invention provides a configurable antenna system comprising a dipole antenna, a tube from plastic or other suitable material, a plurality of adjustable vanes made at least partially from reflected material and that can be pivoted by user to redirect antenna pattern.

DETAILED DESCRIPTION

Traditional directional dipole antennas include the reflector, the primary energy source such as a dipole, and the feed network for feeding the RF energy to the primary source. Such antennas designed to radiate RF energy in specific predetermined direction by the particular reflector surface. The present invention is directed to adjustable reflectors that can change the radiation pattern of a standard dipole antenna. The reflectors can be arbitrary adjusted to provide a desired gain and radiation pattern of the dipole antenna without substantial cost.

Figure 1:
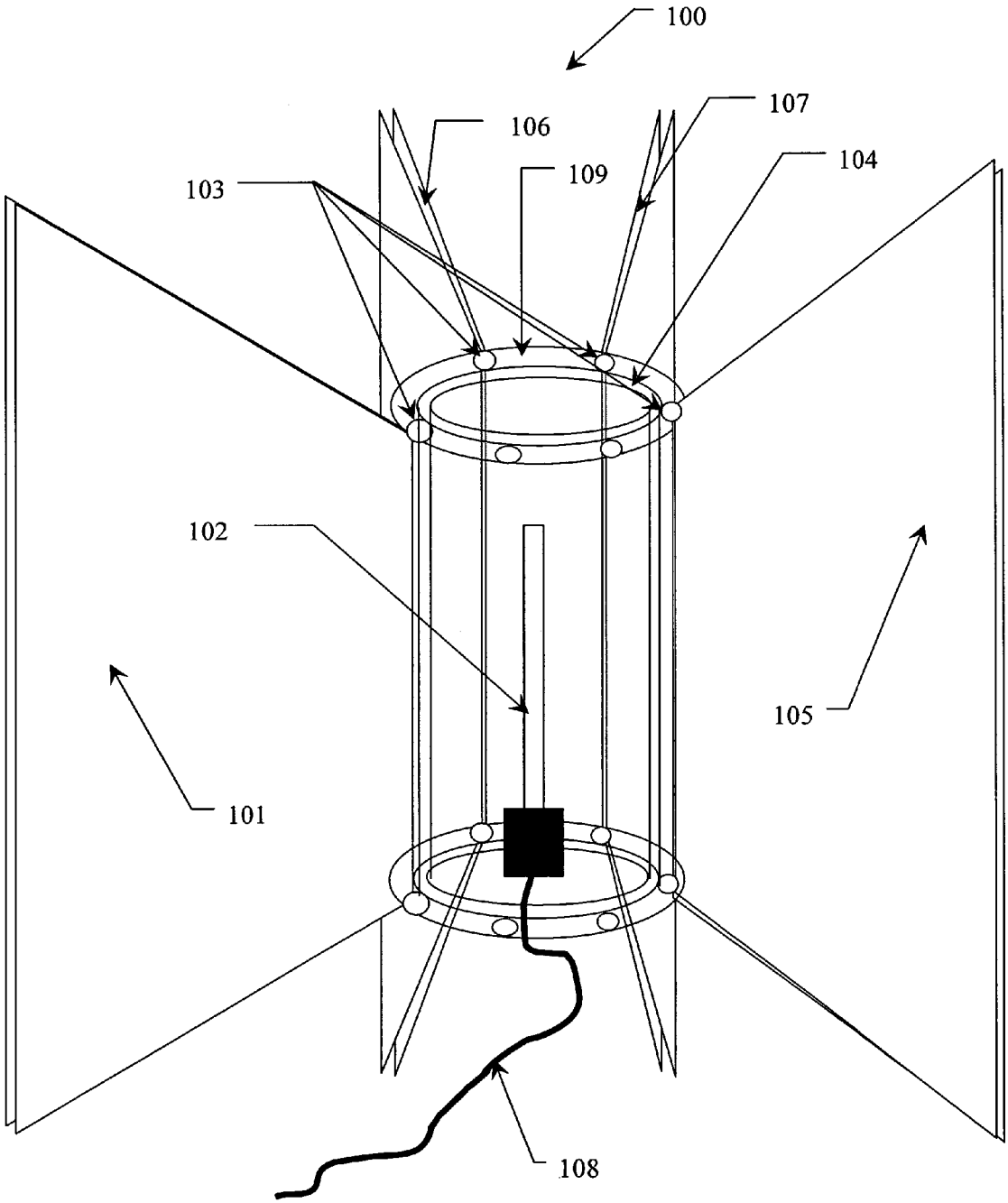
FIG. 1 is showing a simplified schematic view of a field configurable radiation antenna system.
Figure 2:
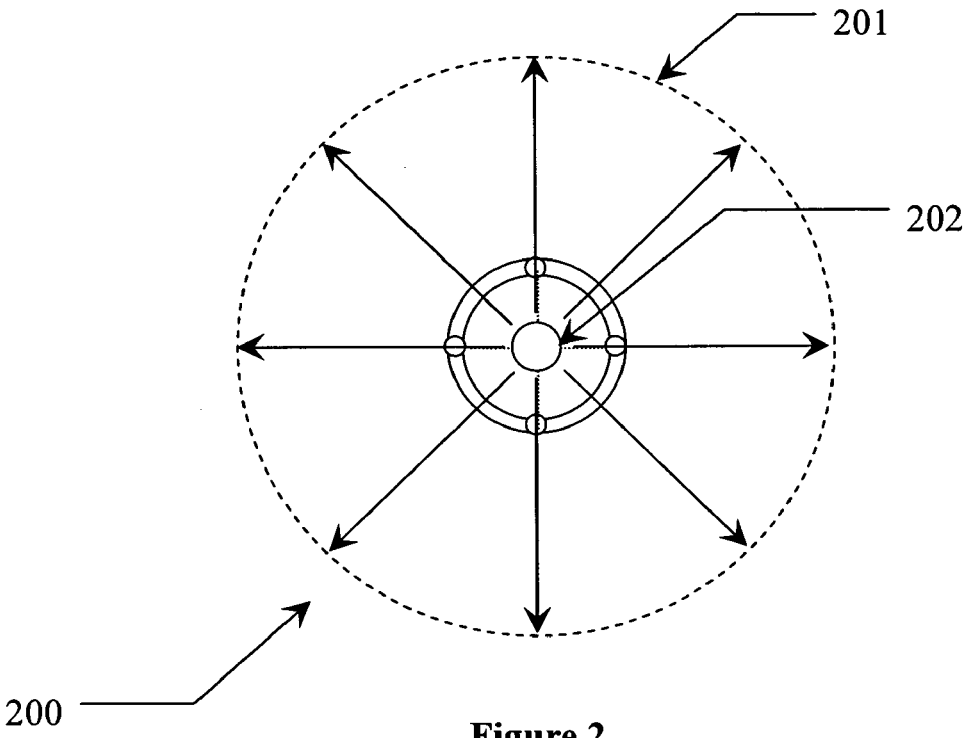
FIG. 2 is showing a simplified schematic view of the radiation pattern of the typical omni antenna without a reflector.
Figure 3:
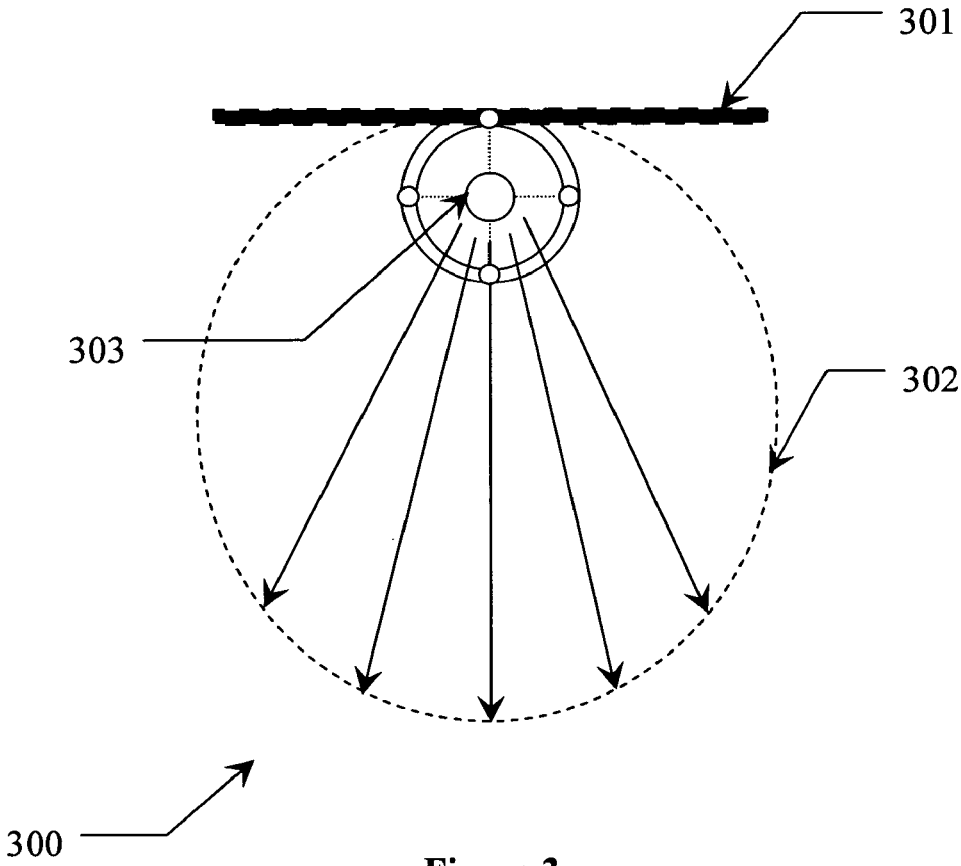
FIG. 3 is showing a simplified schematic of a top view of a radiation pattern for a one hinged reflectors placed behind the dipole antenna.

FIG. 1 shows the field configurable radiation antenna device with single dipole antenna 102, feed element 108 and multiple hinged reflective plates. Said plates may be made from metal or some plastic substance and coated by reflected material. The reflectors can be arbitrary adjusted to provide a desired gain and radiation pattern of the dipole antenna. As illustrated in FIG. 1 an exemplary field configurable radiation antenna system may consist of a hollow tube 104 with connectors 103 that are capable operationally attach directional vanes such as 101, 105, 106, and 107 that reflect the electromagnetic waves in desired direction. The tube 104 may be made from plastic or other suitable material that does not impede the propagation of electromagnetic waves. The dipole antenna 102 may be connected to a tube 104 for the rigidity of construction, if such requirement is desired.

Figure 7:
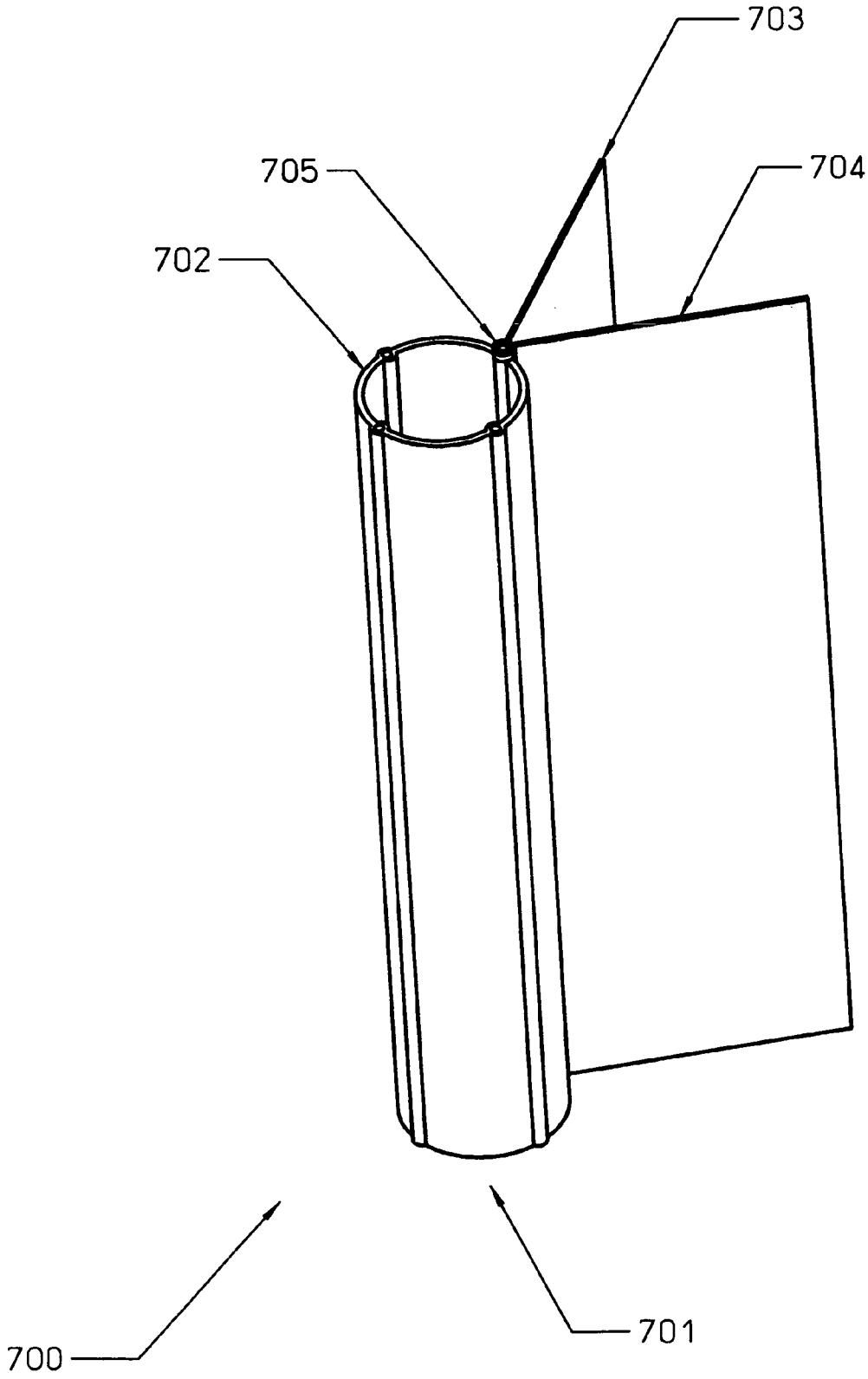
FIG. 7 is showing a simplified schematic view on one of the embodiments of a field configurable radiation antenna system.

The connectors 103 (see FIG. 1) may be moved around the circular tube 109 to position the directional vanes 101, 105, 106, and 107 in specific positions, or can be only attached in predetermined positions, such as position of vanes 703 and 704 connected to outer surface 702 of a circular tube 701 by connector 705 in a field configurable radiation antenna system 700. See FIG. 7.

Figure 4:
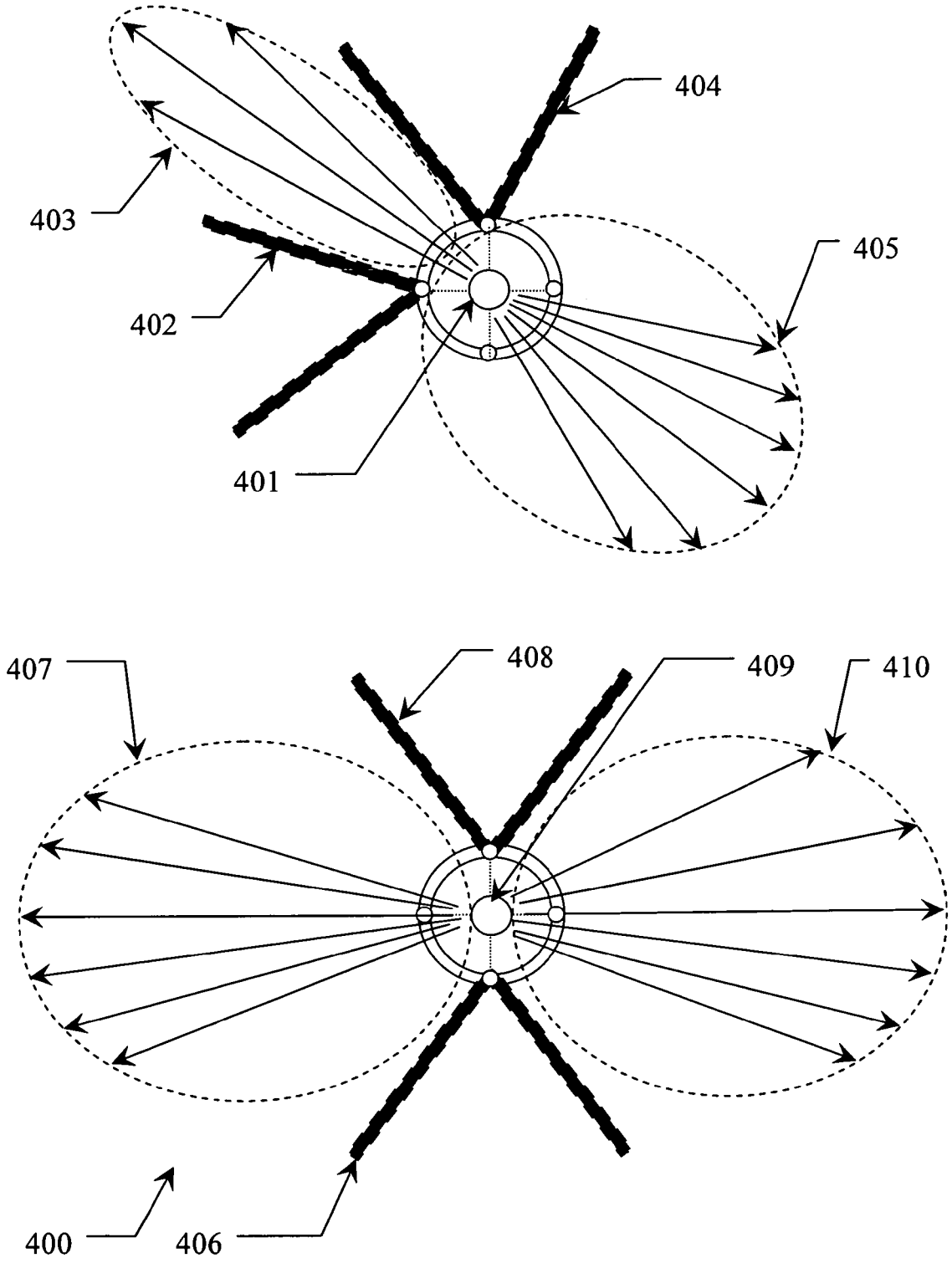
FIG. 4 is showing a simplified schematic of a top view of a radiation pattern for two hinged reflectors set at specific angles.
Figure 5:
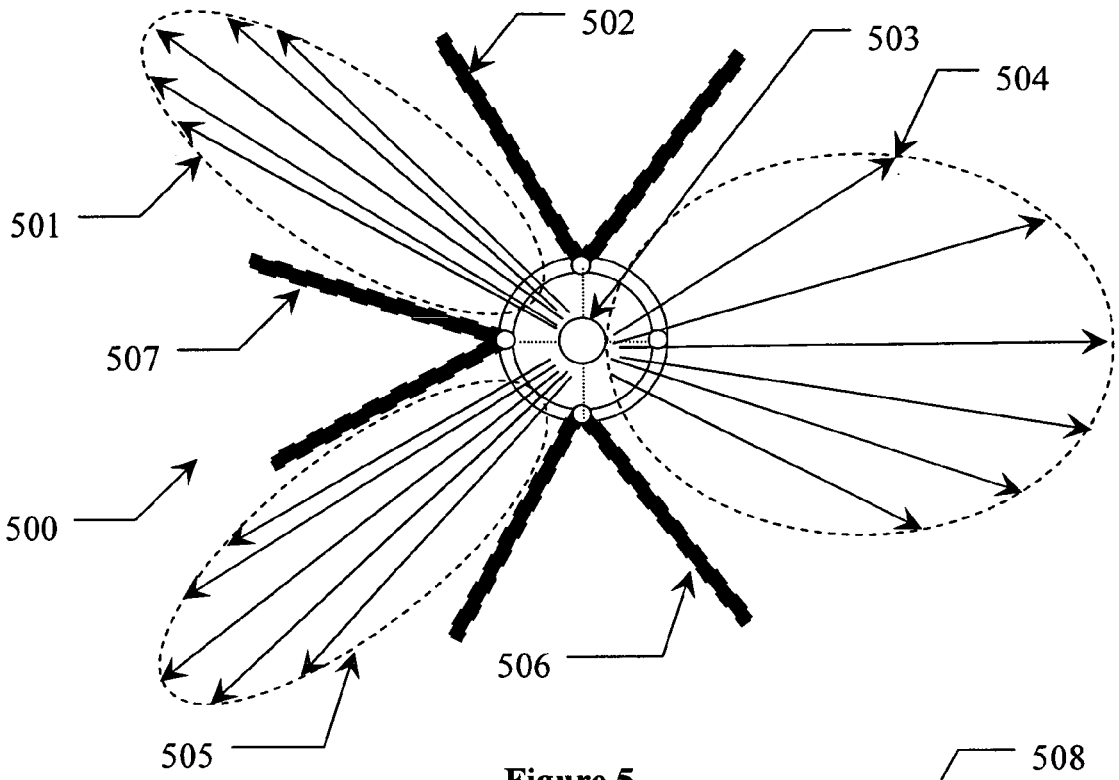
FIG. 5 is showing a simplified schematic of a top view of a radiation pattern for three hinged reflectors set at specific angles.
Figure 6:
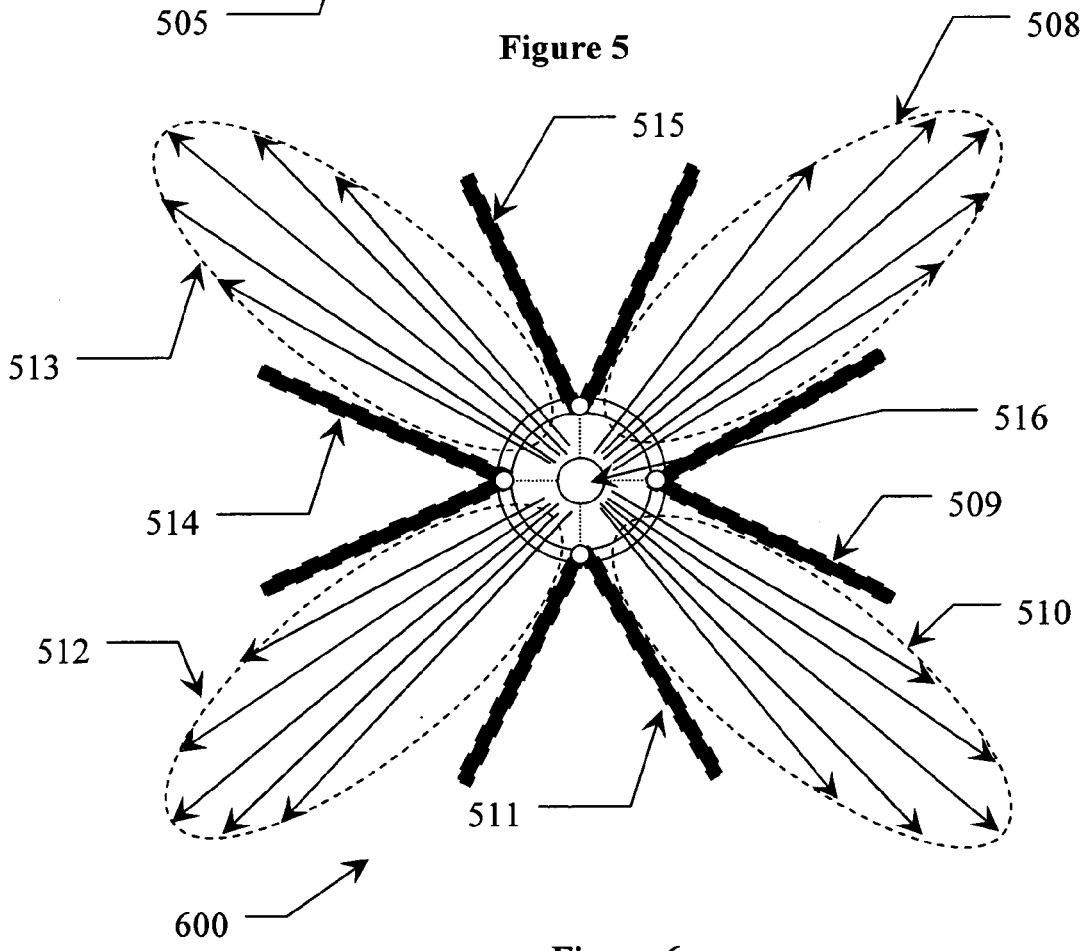
FIG. 6 is showing a simplified schematic of a top view of a radiation pattern for four hinged reflectors set at specific angles.

Furthermore, the hinged reflective plates may be grouped in any preferred way to achieve the selected radiation pattern. The FIG. 4 shows two different radiation patterns that may be achieved with two pairs of vanes.

The directional vanes could be made from a metal of a plastic material with a radio reflective coating. An example of such coating is a metalized coating (aluminum, copper, etc.). There are no specific limitations on the plastic material except that the reflector possesses the desired characteristics in flexibility and durability, which might be different for particular applications.

The field configurable radiation antenna device can be integrated and installed on portable or fixed mounted wireless devices such as hand-held computers, access points, printing devices, scanners, etc. As a practical matter, a comparable directional antenna would cost several times more than the adjustable reflector system.

It will be apparent to those skilled in the art that various modifications and variations can be made in the configurable radiation antenna schemes without departing from the spirit or scope of the present invention.

What is claimed is:

1. A field configurable radiation antenna device, comprising:

a hollow tube;

at least one connector coupled to said hollow tube;

a dipole antenna;

at lease two directional vanes attached by said connector to said hollow tube;

wherein said directional vanes are rotatable relatively said dipole antenna.

2. The field configurable radiation antenna device of claim 1, wherein said directional vanes are made from a plastic material and are coated with radio reflective coating material.

3. The field configurable radiation antenna device of claim 1, wherein said directional vanes are made from metal material.

4. The field configurable radiation antenna device of claim 1, wherein said directional vanes at least partially are coated by radio reflective material.

5. The field configurable radiation antenna device of claim 1, wherein said connector is movable relatively a peripheral surface of said hollow tube.

6. The field configurable radiation antenna device of claim 1, wherein said connector is fixed in one of the plurality of the predetermined positions on the peripheral surface of said hollow tube.

7. The field configurable radiation antenna device of claim 1, wherein said directional vanes are pivotable relatively said hollow tube.

* * * * *